United States Patent [19]

Zung

[11] 4,004,731

[45] Jan. 25, 1977

[54] DEVICE FOR TRANSFERRING HEAT ENERGY FROM A FIREPLACE TO A FLUID HEATING SYSTEM

[76] Inventor: Joseph T. Zung, P.O. Box 491, Rolla, Mo. 65401

[22] Filed: Sept. 5, 1975

[21] Appl. No.: 610,541

[52] U.S. Cl. ..... 237/51; 126/110 R; 126/121

[51] Int. Cl.[2] ..... F24B 7/00

[58] Field of Search ..... 126/120, 121, 135, 200, 126/99 R, 110 R; 237/50, 51, 53

[56] References Cited

UNITED STATES PATENTS

| | | | |
|---|---|---|---|
| 578,240 | 3/1897 | Humphreys | 237/51 |
| 1,558,848 | 10/1925 | Doble, Jr. | 126/110 R |
| 1,915,826 | 6/1933 | Jensen | 237/51 |
| 2,789,554 | 4/1957 | Dupler | 126/120 |
| 2,969,787 | 1/1961 | Dupler | 126/200 |
| 3,685,506 | 8/1972 | Mouat | 126/121 |
| 3,820,527 | 6/1974 | Koch | 126/120 |
| 3,888,231 | 6/1975 | Galluzzo et al. | 126/121 |

*Primary Examiner*—John J. Camby
*Assistant Examiner*—Henry C. Yuen
*Attorney, Agent, or Firm*—Garrettson Ellis

[57] ABSTRACT

A circulating-fluid building heating system, such as a forced air system, is positioned in heat transfer relationship to fireplace chamber-defining walls which sealingly separate the fireplace chamber from the fluid circulation conduit. The fireplace chamber-defining walls have an upper portion which defines wall means which are horizontally extensive and thermally conductive. Accordingly, rising hot gases from a fire in the fireplace chamber impinge the horizontally extensive wall means, for heat exchange with fluid in the circulation conduit. Additionally, solid, transparent, openable and closable doors separate, in closed position, the fireplace chamber from the building interior. Accordingly, a fire in the fireplace chamber may be viewed without removal of large amounts of air from the building interior by means of the fireplace draft.

5 Claims, 3 Drawing Figures

DEVICE FOR TRANSFERRING HEAT ENERGY FROM A FIREPLACE TO A FLUID HEATING SYSTEM

BACKGROUND OF THE INVENTION

At the present time, it is a virtual certainty that the major home heating energy sources such as coal, oil, electricity an gas are all going to come into increasingly short supply, or at least their price will increase very significantly in the years to come.

In many areas of the world, there still is an abundant supply of wood, which can serve as an alternate source of heating for homes and other buildings.

Particularly in homes, wood is burned in a fireplace. However, the conventional fireplace is an extremely inefficient means for heating the home. It barely heats a room and, because of the draft up the chimney of a fire-place having an active fire, it can actually cool down other rooms of the home by sending the interior air up the chimney in a constant draft.

While the Franklin stove and similar devices are more efficient for the heating of a room in a home or another building in wintertime, they are no longer popular in homes for aesthetic reasons, and they are not as effective as modern devices for heating an entire home on a full time basis.

In accordance with this invention, a home fireplace is provided which is in heat exchange communication with a modern circulating fluid home heating system, such as a forced air system. Accordingly, the aesthetic pleasures of a home fireplace can be combined with a source of home heating which is of much greater efficiency than has been available with the previously known fireplace systems, in that a larger percentage of the heat generated by a fire in the fireplace is transferred to a conventional circulating fluid central heating system for distribution throughout the home. Additionally, the fireplace system of this invention is adapted to restrict, as is desired, the outflow of interior building air through the chimney as the fireplace is used.

Accordingly, the fireplace system of this invention can be used for aesthetic reasons, when desired, while gaining a significant amount of heat from the fireplace which is distributed throughout the house by the circulating fluid central heating system. In times of fuel shortage, the fireplace can be used to burn auxiliary fuels such as wood, to assume the burden of warming the house when electricity, oil, or gas is unduly expensive or not available.

DESCRIPTION OF THE INVENTION

In this invention a circulating fluid building heating system, such as a forced air home heating system, includes means defining a pumped fluid circulation conduit and pumped fluid heating means, for temperature control of the building. In accordance with this invention, fireplace chamber-defining walls sealingly separate a fireplace chamber from the fluid circulation conduit. A chimney means communicates with the fireplace chamber. An upper portion of the fireplace chamber defines wall means which are horizontally extensive and thermally conductive, to impinge rising hot gases from a fire in the fireplace chamber, and accordingly to exchange heat from the hot gases to fluid in the circulation conduit.

In another of aspect of this invention, solid, transparent, openable and closable door means are provided to the fireplace chamber so that, when the doors are in closed position, the fireplace chamber is separated from the building interior. Accordingly, the fireplace chamber may be used in the conventional manner when the doors are open. However, when they are closed, the fire in the fireplace chamber may be viewed through the transparent doors without the removal of large amounts of air from the building interior through the chimney means, as usually happens in a conventional fireplace.

In this circumstance, it is preferable for an independent air supply means to provide air from the building exterior to the fireplace chamber, to facilitate combustion therein when the door means are closed position.

In one typical form of this invention, the fireplace chamber is positioned within a heat exchange chamber, which in turn is defined as part of the pumped fluid circulation conduit. Generally, the invention of this application is contemplated for use with a forced air system, although it can also be adapted for use with hot water and steam heat systems as well.

The chimney is desirably positioned in off-center relationship to the fireplace chamber, to increase hot gas impingement against the horizontally extensive, thermally conductive wall means.

Figure 1:
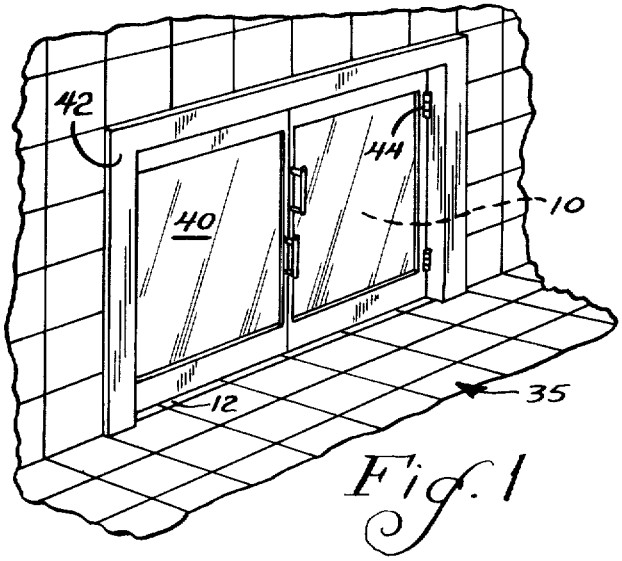
FIG. 1 is a perspective view of one embodiment of the fireplace chamber and door means of this invention as viewed from the building interior.
Figure 3:
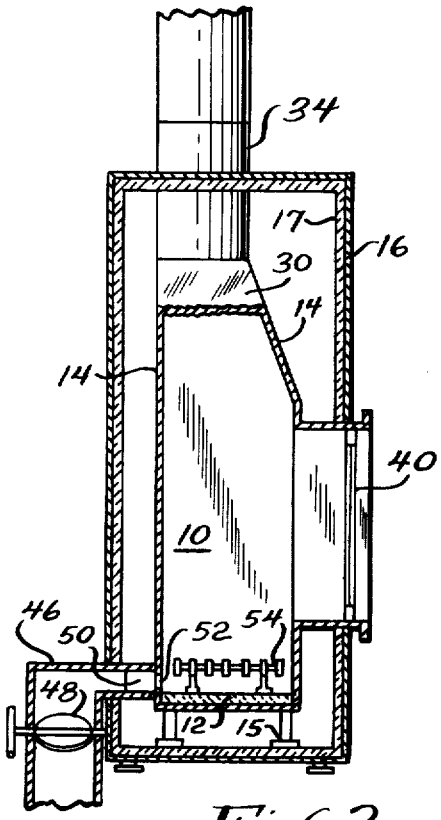
FIG. 3 is a vertical sectional view taken along line 3—3 of FIG. 2.
Figure 2:
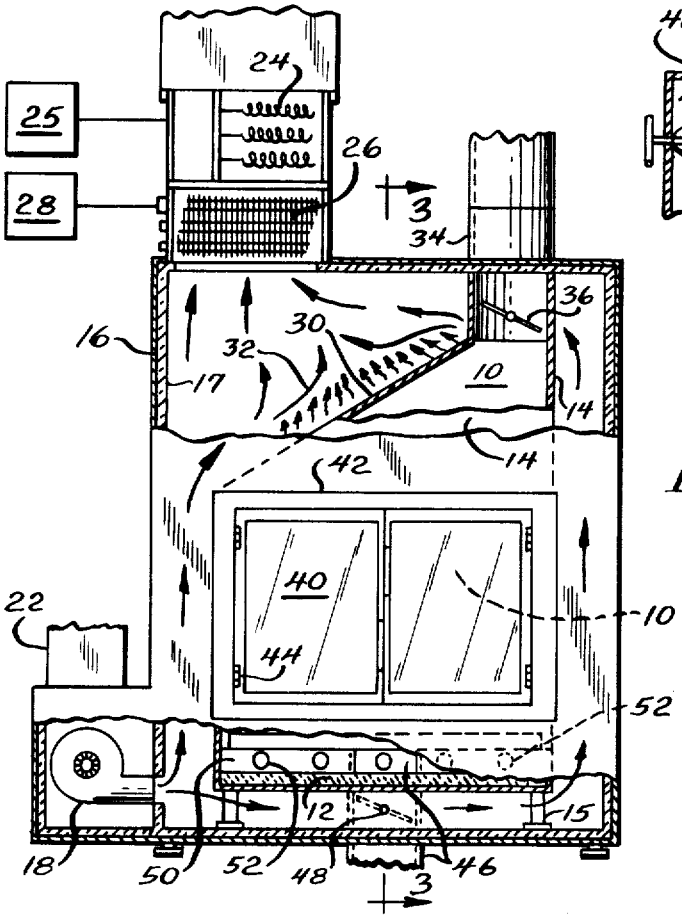
FIG. 2 is a front plan view, with portions broken away, of the structure of this invention.

Referring to the drawings, fireplace chamber 10 is shown, being defined by a hearth 12 and metal walls 14 on all sides. Fireplace chamber 10 is positioned by feet 15 within a heat exchange chamber 16, which is part of a central air heating system for a building such as a home. Chamber 10 is preferably spaced from the walls of chamber 16 on all sides, except as otherwise shown. The walls of chamber 16 may be made of metal, having an insulating layer 17 attached thereto.

As shown in the drawings, a conventional fan 18 forces air into heat exchange chamber 16, around the metal walls and the hearth of the fire chamber 10, and then into air plenum 20, which may be a conventional forced-air plenum leading to branch conduits, for distribution of the heated air through various vents into the building interior.

Intake air is picked up from various other vents in the building interior and is brought by return plenum 22 to fan 18, where the air is forced into heat exchange chamber 16 for heat exchange and circulation into plenum 20.

Heating coils 24 may be located in or adjacent to plenum 20, and may be conventionally heated by gas, electric, or oil heater 25. Alternatively, heater 25 may be a solar heating system.

Also, cooling coils 26 for central conditioning may be conventionally located in or near plenum 20, being operated in a desired manner by an air conditioning compressor 28 to provide central air conditioning to the building.

In accordance with this invention, an upper portion 30 of the wall defining fireplace chamber 10 is horizontally extensive as is shown, and is made of a thermally-conductive materials such as high thermal conditioned steel, for impingment of rising hot gases from a fireplace chamber 10. As a result of this, heat may be exchanged between the hot gases through wall 30 to circulating air 32 in chamber 16 which passes over wall 30 prior to entering plenum 20.

Chimney means 34 is desirably located above a rear corner of fireplace chamber 10, to provide a maximum amount of horozontal extension of wall 30 for increased heat exchange efficiency. It is also optionally desirable for wall 30 to be made of corrugated or otherwise convoluted steel to increase its surface area, for added heat exchange efficiency.

Chimney valve 36 is shown to be a flapper type valve which may be controlled from the exterior by a handle or the like, to selectively obstruct or permit flow through chimney 34. As is conventional, valve 36 is open during burning of a fire in fireplace chamber 10, and it is otherwise closed, particularly in winter to avoid the escape of warm air through the chimney. When chimney valve 36 is closed, and the fire is not present in chamber 10, the normal home heating system can operate without a significant amount of heat loss from chamber 16 through chimney 34.

If desired, a second chimney valve (not shown) can be provided in chimney 34 to restrict heat loss through the chimney even more.

Fireplace chamber 10 is exposed to an interior room 35 of the building in which it is installed, as in FIG. 1, being separated by openable and closable transparent doors 40, which may be made of tempered glass, and which are shown to be attached to frame 42 about the opening to fire chamber 10 by hinges 44.

An air supply conduit 46 communicates with the building exterior, being controlled by flapper valve 48 for blocking air flow when desired, for providing air to the fireplace chamber when doors 40 are in closed position. Air from conduit 46 passes into a manifold array comprising transverse conduit 50, passing essentially the width of fireplace chamber 14 and communicating with the chamber through a series of ports 52, so that air can be uniformly distributed throughout the lower portions of the fireplace chamber.

As a result, when efficient warming of the home is desired, a wood or coal fire may be lit on grate 54 in fireplace chamber 10, and doors 40 may be closed. Valves 36 and 48 are opened, which can result in a hot fire burning in the chamber behind doors 40 and visible through them. Heat passes through the doors 40 by infra red radiation, to provide much of the warming effect of conventional fires, while air for the fire passes through conduit 46 and ports 52.

Hot fumes from the fire accordingly rise to impinge wall 30, for heat exchange, and then pass out of chimney 34. Heat from the hot fumes is picked up by the circulating air in chamber 16, which in turn passes through plenum 20 and then into the building, while cold air is collected through plenum 22, and is recirculated to wall 30, as well as the other walls 14 of fireplace chamber 10 through which heat exchange can also be effected.

As a result of this, heat is transmitted by radiation through doors 40 into room 35, without the loss or warm room air by suction through chimney 34. However, as an additional benefit, further heat is provided directly to the forced air system of the building, so that the fire may be enjoyed while at the same time a large percentage of the heat may be efficiently utilized, to save other energy which would be conventionally expended to heat the house.

Alternatively, the glass doors 40 may be opened, and the fire enjoyed in the conventional manner.

Generally, it is preferably for wall 30 to project upwardly toward the chimney 34 at an angle with respect to the horizontal of about 30° to 50°. Specifically, the angle shown is about 35°. This range of angle is believed to retain an adequate draft in the fireplace chamber, while increasing the exchange of heat through wall 30 to circulating air in chamber 16.

The above has been offered for illustrative purposes only, and is not for the purpose of limiting the invention of this application, which is as defined in the claims below.

What is claimed is:

1. In a circulating-air building temperature control system including means defining a pumped air circulation conduit for distributing controlled temperature air throughout the building and collecting return air, plus air heating means and cooling means for temperture control of the building positioned within said air circulation conduit, the improvement comprising:

an auxiliary heating unit positioned within said air circulation conduit, comprising a fireplace for burning solid fuel, defined by fireplace chamber walls and grate means for holding the fuel, said air circulation conduit being positioned about the exterior of said fireplace chamber walls, said fluid circulation conduit being sealed from said fireplace chamber;

chimney means communicating with said fireplace chamber, said chimney means being positioned in off-center relationship to said fireplace chamber; and a heat-conductive wall sealing the upper end of said fireplace chamber about the chimney, said conductive wall being positioned to slope upwardly from the end of the fireplace chamber remote from said chimney means to said chimney means, said sloped wall overlying a major portion of said fireplace chamber; solid, transparent, openable and closable door means to separate, in closed position, said fireplace chamber from the building interior, whereby a fire in said fireplace chamber may be viewed without the removal of large amounts of air from the building interior through the chimney means; and independent air supply means to provide air from the building exterior to the fireplace chamber, to facilitate combustion therein.

2. The system of claim 1 in which said independent air supply means includes an air inlet conduit communicating with the out-of-doors, a transverse conduit communicating with the said inlet conduit extending essentially the width of said fireplace chamber, and a plurality of ports, spaced along said transverse conduit, communicating between said transverse conduit and said fireplace chamber for the uniform distribution of air.

3. The system of claim 1 in which said air heating means positioned in the air circulation conduit is also positioned adjacent to and carried by said auxiliary heating unit.

4. The system of claim 1 in which said thermally conductive wall means defines a slope with respect to the horizontal of about 30° to 50° upwardly to said chimney means.

5. The system of claim 4 in which said air cooling means includes central air conditioning cooling coils positioned adjacent to and carried by said fireplace heating unit.

* * * * *